US011242238B2

(12) United States Patent
Reid

(10) Patent No.: US 11,242,238 B2
(45) Date of Patent: Feb. 8, 2022

(54) FUEL DELIVERY SYSTEM HAVING ADDITIVE INJECTION ASSEMBLY

(71) Applicant: Veeder-Root Company, Simsbury, CT (US)

(72) Inventor: Kent Reid, Canton, CT (US)

(73) Assignee: Veeder-Root Company, Simsbury, CT (US)

( * ) Notice: Subject to any disclaimer, the term of this patent is extended or adjusted under 35 U.S.C. 154(b) by 0 days.

(21) Appl. No.: 16/915,542

(22) Filed: Jun. 29, 2020

(65) Prior Publication Data

US 2020/0407210 A1 Dec. 31, 2020

Related U.S. Application Data

(60) Provisional application No. 62/868,160, filed on Jun. 28, 2019.

(51) Int. Cl.
*B67D 7/04* (2010.01)
*B67D 7/32* (2010.01)
*B67D 7/74* (2010.01)

(52) U.S. Cl.
CPC ..... *B67D 7/04* (2013.01); *B67D 7/32* (2013.01); *B67D 7/743* (2013.01)

(58) Field of Classification Search
CPC . B67D 7/04; B67D 7/32; B67D 7/743; B67D 7/78; B67D 7/68; B67D 7/744
See application file for complete search history.

(56) References Cited

U.S. PATENT DOCUMENTS 5,163,586 A 11/1992 Zinsmeyer
5,954,080 A 9/1999 Leatherman
(Continued)

FOREIGN PATENT DOCUMENTS

WO 9932395 A1 7/1999

OTHER PUBLICATIONS

International Search Report and Written Opinion dated Sep. 28, 2020, for corresponding international application serial No. PCT/US2020/040154, all enclosed pages cited.
(Continued)

*Primary Examiner* — Jason K Niesz
(74) *Attorney, Agent, or Firm* — Nelson Mullins Riley & Scarborough LLP

(57) ABSTRACT

A fuel dispensing system for dispensing fuel into a vehicle comprises a stationary fuel tank adapted to contain a quantity of fuel. At least one fuel dispenser is in fluid communication with the fuel tank via piping. A pump is operative to transfer fuel from the fuel tank to the fuel dispenser. A level detector is located in the fuel tank. A tank monitor is in electronic communication with the level detector, the tank monitor being operative to produce information indicative of the quantity of fuel in the fuel tank. The fuel dispensing system further includes a fuel additive injection assembly comprising an additive reservoir configured to contain a quantity of fuel additive. A controller is in electronic communication with the tank monitor to receive information indicating a delivery of fuel into the fuel tank, the controller having a processor and memory operative to execute instructions determining when an additive quantity should be provided. Additive piping defines a flow path extending between the additive reservoir and a discharge location. A valve is situated along the flow path, the valve being in electronic communication with the controller to open so that the fuel additive will flow along the flow path. A meter is also situated along the flow path and is operative to measure a flow of the fuel additive, the meter being in electronic communication with the controller.

20 Claims, 4 Drawing Sheets

(56) References Cited

U.S. PATENT DOCUMENTS

| | | | | |
|---|---|---|---|---|
| 6,352,176 | B1 | 3/2002 | Hartsell, Jr. et al. | |
| 6,435,204 | B2 | 8/2002 | White et al. | |
| 7,561,040 | B2 | 7/2009 | Reid et al. | |
| 8,733,590 | B2 | 5/2014 | Bartlett et al. | |
| 9,759,631 | B2 | 9/2017 | Hart | |
| 2003/0028285 | A1* | 2/2003 | Zura | G06Q 10/08 700/241 |
| 2021/0107782 | A1* | 4/2021 | Swanek | B67D 7/743 |

OTHER PUBLICATIONS

Hose Assembly Tips (https://www.hoseassemblytips.com/quick-connect-couplings/) dated Aug. 31, 2016, all enclosed pages cited.

* cited by examiner

FUEL DELIVERY SYSTEM HAVING ADDITIVE INJECTION ASSEMBLY

PRIORITY CLAIM

This application is based upon and claims the benefit of provisional application Ser. No. 62/868,160, filed Jun. 28, 2019, incorporated fully herein by reference for all purposes.

BACKGROUND

The present invention relates generally to equipment used in fuel dispensing environments. More specifically, the present invention relates to a fuel delivery system having an additive injection assembly to provide a fuel additive to fuel being delivered to a fuel storage tank.

As is well known known, liquid fuel delivery systems typically include one or more fuel dispensers located in the forecourt area of a service station. The fuel dispensers are connected via piping with a source of the liquid fuel (e.g., a tank containing gasoline). Typically, the piping is located under the forecourt so as to feed the liquid fuel from an underground storage tank (UST). Multiple USTs may be provided for different types or grades of fuel. Fuel grades can be mixed as necessary or desired to yield still further grades of fuel.

Modern fueling environments may store liquid fuels which are mixtures of gasoline and ethanol in various ratios, rather than "pure" gasoline. For example, E10 is a liquid fuel comprising 90% gasoline and 10% ethanol. In addition, fuel retailers often wish to provide fuel with various additives, such as fuel injector cleaner. Generally, the additive is mixed with the fuel at a central depot before delivery to the retailer. In particular, a fuel additive injection system of the prior art will meter a predefined amount of additive into a load of fuel based on the quantity that is intended to be transported and delivered into the receiving tank.

SUMMARY

The present invention recognizes and addresses various considerations of prior art constructions and methods. According to one embodiment, the present invention provides a fuel dispensing system for dispensing fuel into a vehicle. The fuel dispensing system comprises a stationary fuel tank adapted to contain a quantity of fuel. At least one fuel dispenser is in fluid communication with the fuel tank via piping. A pump is operative to transfer fuel from the fuel tank to the fuel dispenser. A level detector is located in the fuel tank. A tank monitor is in electronic communication with the level detector, the tank monitor being operative to produce information indicative of the quantity of fuel in the fuel tank.

The fuel dispensing system further includes a fuel additive injection assembly comprising an additive reservoir configured to contain a quantity of fuel additive. A controller is in electronic communication with the tank monitor to receive information indicating a delivery of fuel into the fuel tank, the controller having a processor and memory operative to execute instructions determining when an additive quantity should be provided. Additive piping defines a flow path extending between the additive reservoir and a discharge location. A valve is situated along the flow path, the valve being in electronic communication with the controller to open so that the fuel additive will flow along the flow path. A meter is also situated along the flow path and is operative to measure a flow of the fuel additive, the meter being in electronic communication with the controller.

In some exemplary embodiments, the discharge location is situated to provide the fuel additive directly into the fuel tank. For example, the discharge location may be at a fuel delivery port on the fuel tank. According to another embodiment, the discharge location may be at a delivery nozzle that is inserted into a fuel delivery port on the fuel tank. For example, the additive piping may include a quick-connect coupling for attaching the additive piping to the delivery nozzle.

In some exemplary embodiments, the controller is operative, along with the valve and the meter, to provide a selected quantity of fuel additive per incremental quantity of fuel delivered. The controller may be further operative to receive dispensing information regarding dispensing of fuel at the fuel dispenser(s) and utilize the dispensing information in determining the additive quantity. The fuel additive injection assembly may be configured as a unit mounted on a mobile structure that can be moved from place to place.

Another aspect of the present invention relates to a method for providing a fuel additive into a stationary fuel tank as fuel is delivered into the fuel tank. One step of the method involves the step of providing an additive injection assembly operative to selectively discharge the fuel additive into the fuel tank. Another step involves determining that a delivery of the fuel into the fuel tank is occurring. According to another step, it is determined when a first threshold quantity of the fuel has been delivered. A first additive quantity of the fuel additive is injected into the fuel tank based on delivery of the first threshold quantity of the fuel.

A still further aspect of the present invention provides a fuel additive injection assembly comprising an additive reservoir configured to contain a quantity of fuel additive. A controller is adapted to be in electronic communication with a tank monitor to receive information indicating a delivery of fuel into a fuel tank, the controller having a processor and memory operative to execute instructions determining when an additive quantity should be provided. Additive piping defines a flow path extending between the additive reservoir and a discharge location. A valve is situated along the flow path, the valve being in electronic communication with the controller to open so that the fuel additive will flow along the flow path. A meter is situated along the flow path and is operative to measure a flow of the fuel additive, the meter being in electronic communication with the controller.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one skilled in the art, is set forth in the specification, which makes reference to the appended drawings, in which.

Figure 1:
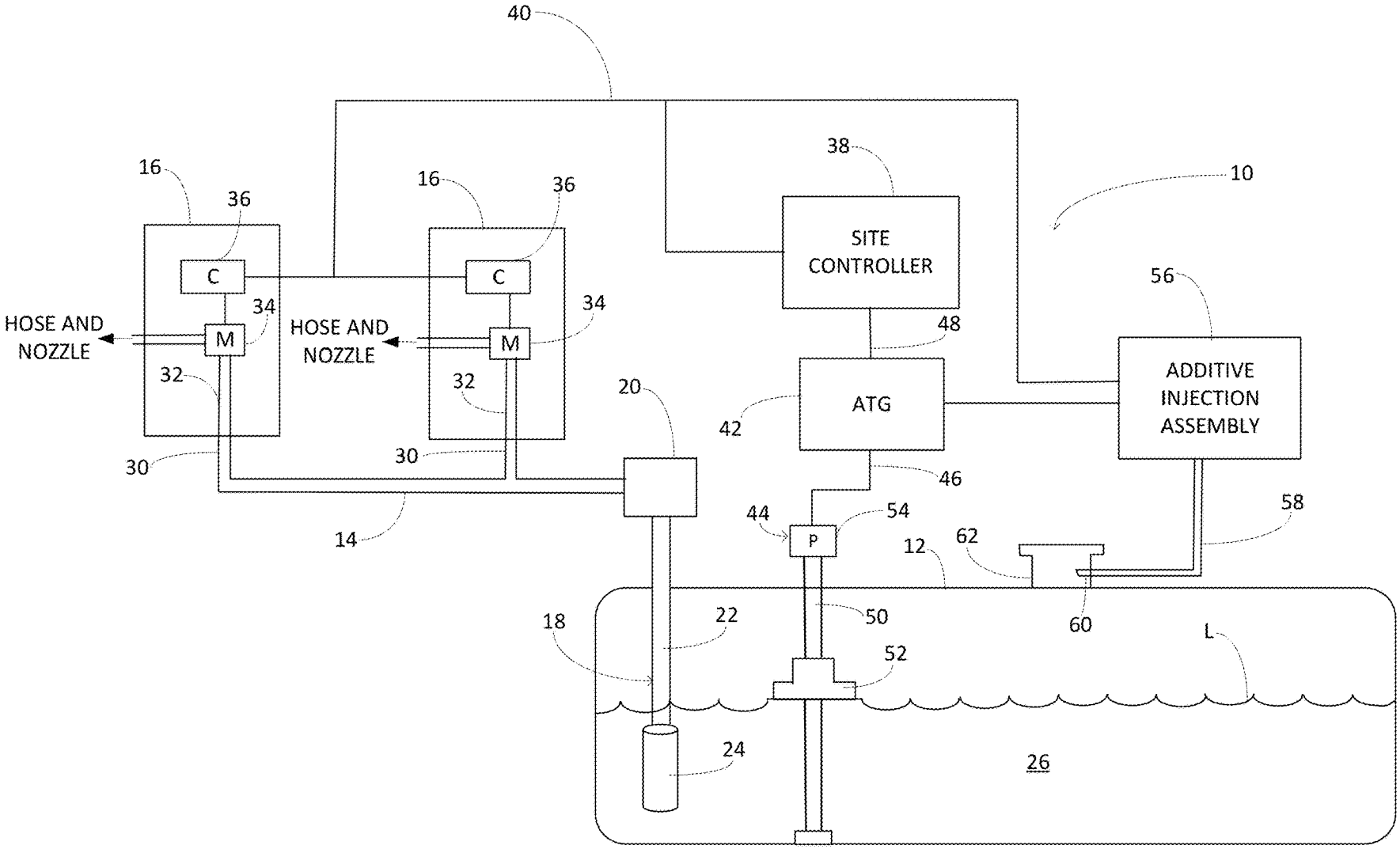
FIG. 1 is a diagrammatic representation of a fuel dispensing system including an additive injection assembly in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the present disclosure including the appended claims and their equivalents.

Fuel retailers may desire to provide certain additives to the fuel before it is sold, such as a fuel injector cleaner, to provide more value to their customers. In this regard, FIG. 1 is a diagrammatic representation of a fuel dispensing system 10 in a retail service station environment according to an aspect of the present invention. In general, fuel may travel from an underground storage tank (UST) 12 via main fuel piping 14, which may be double-walled pipe having secondary containment as is well known, to one or more fuel dispensers 16 for delivery. As one skilled in the art will recognize, each of fuel dispensers 16 will typically be equipped with a flexible hose having a manually-operated nozzle at its distal end. Exemplary underground fuel delivery systems are illustrated in U.S. Pat. Nos. 6,435,204, 7,561,040, and 8,733,590, each of which is incorporated by reference in its respective entirety for all purposes.

More specifically, a submersible turbine pump (STP) 18 associated with the UST 12 is used to pump fuel to the fuel dispenser(s) 16. (In some embodiments, the fuel dispensers may be self-contained, meaning that fuel is drawn to the fuel dispenser by a pump unit positioned within the fuel dispenser housing.) STP 18 has a distribution head 20 containing power and control electronics that provide power through a boom 22 to a turbine pump contained inside a turbine pump housing 24. STP 18 may preferably be the RED JACKET® submersible turbine pump, manufactured by the Veeder-Root Co. of Simsbury, Conn. There may be a plurality of USTs 12 and STPs 18 in a service station environment if more than one type or grade of fuel 26 is to be delivered by a fuel dispenser 16.

The turbine pump operates to draw fuel 26 upward from the UST 12 into the boom 22 for delivery to the fuel dispenser 16. After STP 18 draws the fuel 26 into the distribution head 20, the fuel 26 is carried through head 20 to main fuel piping 14. A check valve 28 (FIG. 2) may be located in head 20 to prevent backflow of fuel from main fuel piping 14 into the UST 12 when STP 18 is not operating. Main fuel piping 14 carries fuel 26 to fuel dispenser(s) 16 for eventual delivery.

Specifically, fuel passes from main fuel piping 14 into branch piping 30 corresponding to each of the fuel dispensers 16. Each of branch piping 30 is in fluid communication with respective internal fuel piping 32 of an associated fuel dispenser 16. After fuel 26 enters into internal fuel piping 32, it may encounter a flow control valve (not shown) positioned upstream of a flow meter 34. (In some fuel dispensers, the valve may be positioned downstream of the flow meter 34.) In one embodiment, the valve may be a proportional solenoid controlled valve, such as described in U.S. Pat. No. 5,954,080, hereby incorporated by reference in its entirety for all purposes.

The flow control valve in the respective fuel dispenser 16 is under control of a control system 36. In this manner, control system 36 can control the opening and closing of the flow control valve to either allow fuel to flow or not flow through meter 34 and on to the hose and nozzle. Control system 36 may be any suitable electronics with associated memory and software programs running thereon. In a preferred embodiment, control system 36 may be comparable to the microprocessor-based control systems used in CRIND and TRIND type units sold by Gilbarco Inc. Control system 36 typically controls other aspects of fuel dispenser 16, such as displays and the like as is well understood. For example, control system 36 typically instructs the flow control valve to open when a fueling transaction is authorized.

In addition, each control system 36 may be in electronic communication with a site controller 38 via a fuel dispenser communication network 40. Communication network 40 may be any suitable link, such as two wire, RS 422, Ethernet, wireless, etc. as needed or desired. Site controller 38 communicates with control systems 36 to control authorization of fueling transactions and other conventional forecourt control activities. For example, the site controller functions may be provided by the PASSPORT® point-of-sale system manufactured by Gilbarco Inc. or by a separate forecourt controller.

Meter 34 preferably measures the flow rate of fuel 26 as fuel is dispensed. (In some embodiments, meter 34 may be capable of measuring the density and/or temperature of the flowing fuel.) In this regard, flow meter 34 may be any suitable flow meter known to those of skill in the art, including positive displacement, inferential, and Coriolis mass flow meters, among others. Meter 34 typically comprises electronics that communicate information representative of the flow rate, density, and/or temperature of fuel to control system 36. For example, the meter electronics may typically include a pulser as known to those skilled in the art. In this manner, control system 36 can update the total gallons (or liters) dispensed and the price of the fuel dispensed on an information display of fuel dispenser 16. The volume of fuel dispensed is also provided to site controller 38 via network 40.

UST 12 includes an automatic tank gauge (ATG) system to monitor level of fuel 26. The gauging system includes a tank monitor 42 in electronic communication with a probe ("P") 44 (e.g., a magnetostrictive probe) such as via an appropriate signal line 46. In turn, tank monitor 42 is in electronic communication with site controller 38, such as via signal line 48. Preferably, tank monitor 42 is a microprocessor-based system having suitable program instructions stored in memory to perform the desired functions. For example, tank monitor 42 may comprise the TLS-450 or TLS-350 systems manufactured by Veeder-Root Company.

Probe 44 includes a probe shaft 50 that extends through the interior of UST 12, as shown. A fuel level float 52 is able to slide along the shaft 50 as the liquid levels change. As a result, the amount of fuel 26 in UST 12 can be determined. As shown, probe 44 includes an electronics head 54 at the end of probe shaft 50, located external to UST 12. Head 54 generates signals provided to tank monitor 42 that are indicative of the locations of float 52. In an example embodiment, probe 44 may comprise the Mag Plus magnetostrictive probe system manufactured by Veeder-Root Company.

Fuel dispensing system 10 further comprises an additive injection assembly 56 operative to provide appropriate amounts of fuel additive as new fuel is being delivered to UST 12. In this embodiment, for example, assembly 56 includes additive piping 58 that defines a flow path for the additive to be provided. The distal end of piping 58 defines a discharge location 60 where the additive will mix with the fuel as it is being delivered. Discharge location 60 may be, for example, situated at the delivery port 62 of UST 12 where the delivered fuel is "dropped" into the tank.

Figure 2:
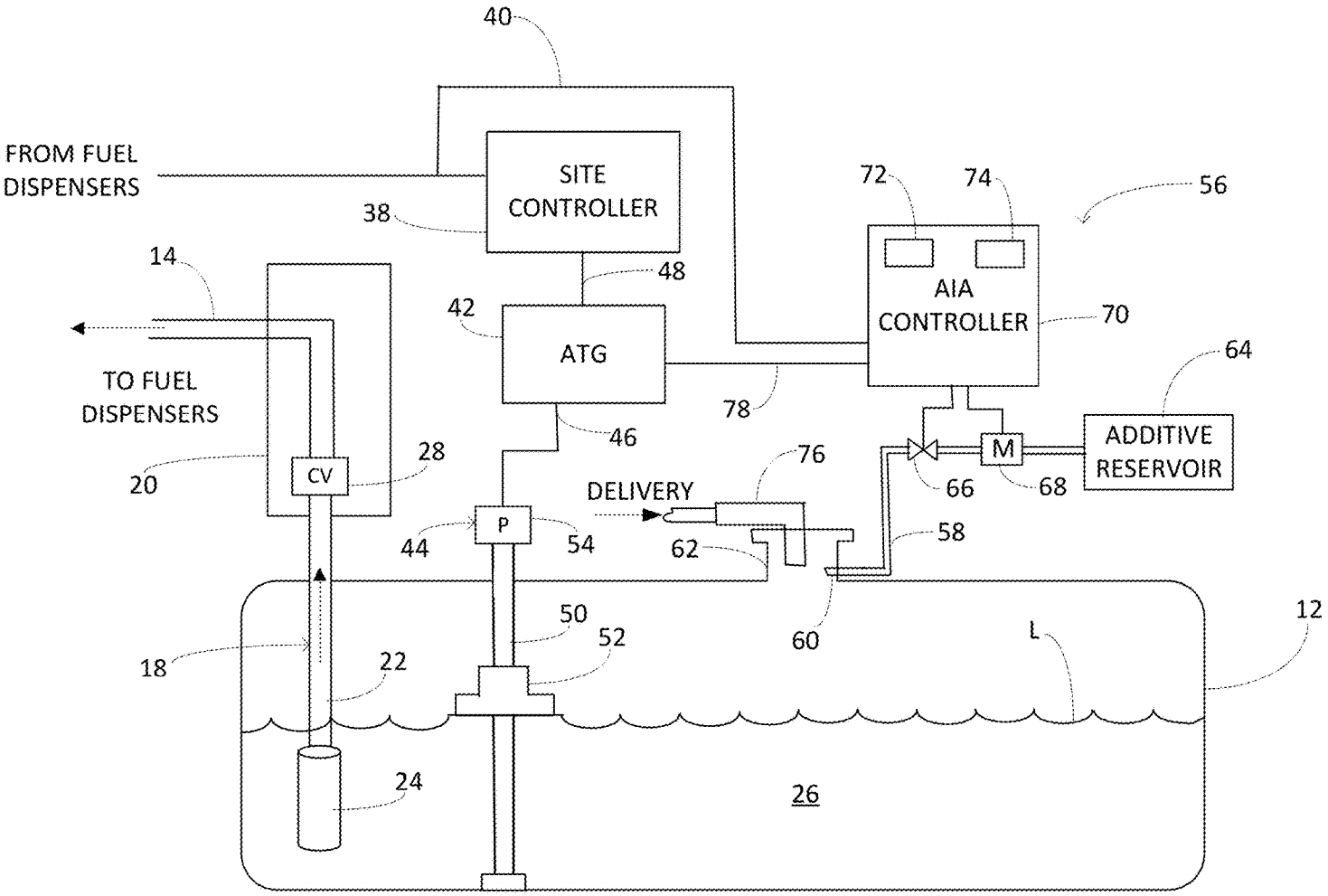
FIG. 2 is a diagrammatic representation of a portion of the fuel dispensing system of FIG. 1 showing further details.

Referring now to FIG. 2, certain further details of assembly 56 can be most easily explained. In this regard, assembly 56 includes an additive reservoir 64 configured to contain a quantity of fuel additive. Reservoir 64 is in fluid communication with the proximal end of additive piping 58. In addition, a valve 66 and a meter 68 are located along the flow path of the additive piping 58. Valve 66, which may be a proportional or binary solenoid controlled valve in various embodiments, opens to allow the fuel additive to flow from reservoir 64 to discharge location 60. Meter 68 measures the flow rate of the fuel additive, so that the quantity of fuel additive being provided can be determined.

Additive injection assembly 56 further includes a controller 70 in electronic communication with valve 66 and meter 68. As will be explained, controller 70 operates to open valve 66 so that additive will flow to discharge location 60. After the desired amount of additive has been provided, as measured by meter 68, controller 70 functions to close valve 66. In this regard, controller 70 includes a processor 72 and memory 74 executing suitable program instructions.

The processor 72 of controller 70 may be a suitable electronic processor, whether referred to as a processor, microprocessor, microcontroller, etc. (which are intended herein as equivalent terms), or a combination of separate components that together function as a processor. The memory 74 (and other memories discussed herein) may be any suitable memory or computer-readable medium as long as it is capable of being accessed by the control system, including random access memory (RAM), read-only memory (ROM), erasable programmable ROM (EPROM), or electrically EPROM (EEPROM), CD-ROM, DVD, or other optical disk storage, solid-state drive (SSD), magnetic disc storage, including floppy or hard drives, any type of suitable non-volatile memories, such as secure digital (SD), flash memory, memory stick, or any other medium that may be used to carry or store computer program code in the form of computer-executable programs, instructions, or data.

As noted above, new fuel is delivered to tank 12 at port 62. For example, a delivery nozzle ("elbow") 76 at the end of a delivery hose may be inserted (partially) into port 62 to "drop" the new fuel. The other end of the delivery hose is connected to a mobile tanker to receive the fuel to be added to UST 12. The addition of fuel to UST 12 causes the level L of fuel 26, and thus the float 52, to rise. As a result, tank monitor 42 "knows" that a delivery is occurring and how much the fuel inventory is increasing. This information is provided, such as by signal line 78, to controller 70. In this way, controller also "knows" that a drop is occurring so that an appropriate quantity of fuel additive can be provided. In addition, controller 70 is also preferably in electronic communication with fuel dispenser(s) 16, such as via network 40, so that controller 70 also "knows" whether fuel is being dispensed to customers at the same time that new fuel is being added to UST 12.

Figure 3:
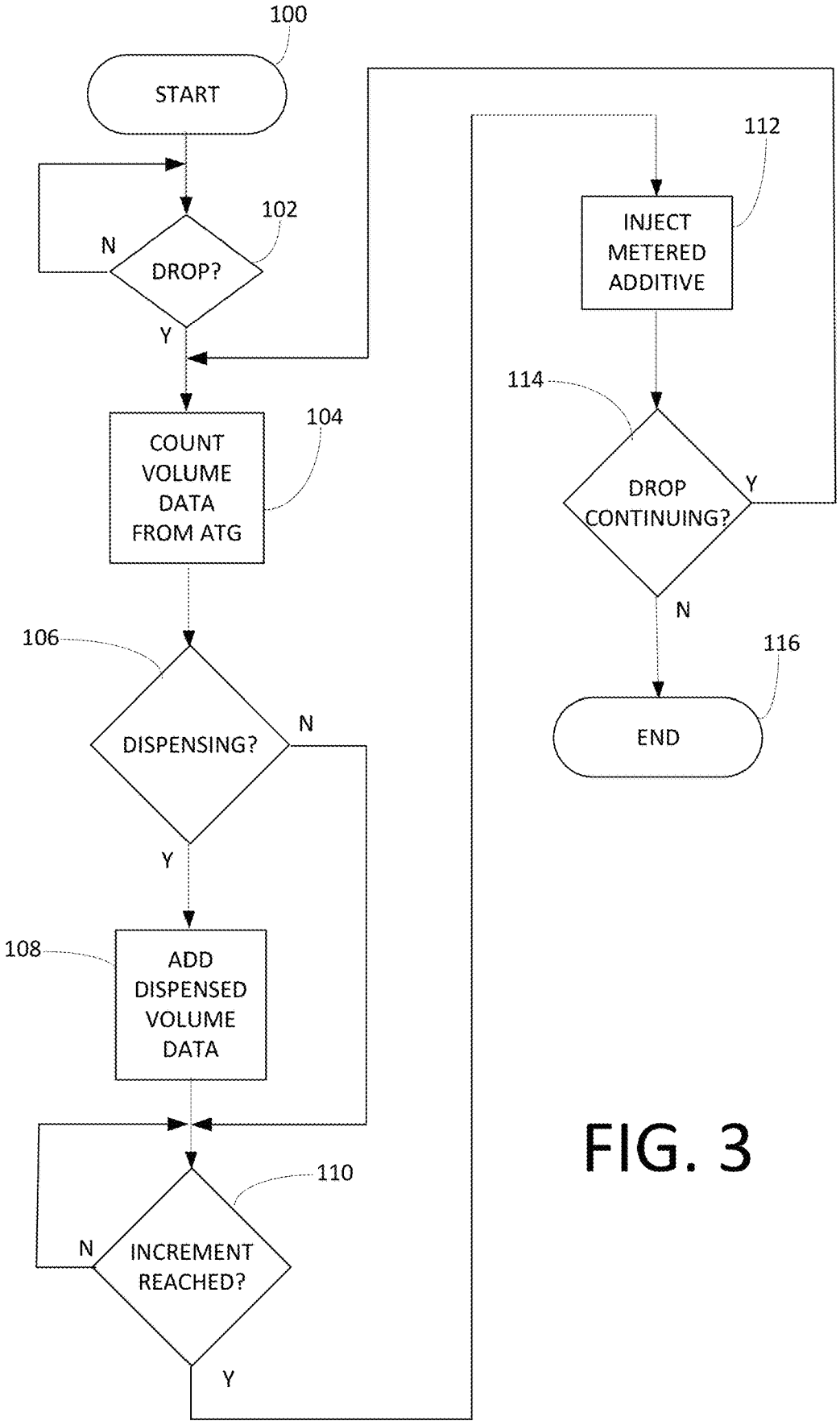
FIG. 3 is a flowchart showing operation of certain aspects of the additive injection assembly of FIG. 1.

Referring now to FIG. 3, the operation of assembly 56 in accordance with a preferred embodiment can be most easily explained. The process starts at 100. Based on information received from tank monitor 42, controller 70 determines at 102 whether a fuel "drop" (i.e., delivery of fuel into the UST 12) is occurring. If not, the process continues to monitor for the initiation of a fuel drop. If so, the process continues to 104, where controller 70 determines the quantity of fuel being added to UST 12. One skilled in the art will appreciate that controller 70 may itself determine the volume added based on level information from the tank monitor 42 or may receive the calculated volume from tank monitor 42. Moreover, because level indicates volume of fuel, the terms "level" and "volume" are considered to be equivalent for purposes of the present disclosure. Both are indicative of the "quantity" of fuel in or added to UST 12.

In this embodiment, controller 70 also receives information from the fuel dispensers 16 regarding whether fuel is being dispensed to a customer and, if so, how much. Thus, as indicated at 106, controller 70 determines whether one or more dispensing events are occurring. If a dispensing event is occurring, the quantity of dispensed fuel is added to the running total of fuel being delivered to UST 12 (as indicated at 108). In any event, as indicated at 110, controller 70 determines whether a predetermined increment in quantity of fuel added to UST 12 has been reached. If the predetermined quantity has not been reached, the process continues to monitor the added quantity until the predetermined quantity has been reached.

When the predetermined quantity of added fuel has been reached, a metered quantity of the fuel additive is provided corresponding to the predetermined quantity of fuel added (i.e., incremental quantity) to the UST 12 (as indicated at 112). As discussed below, the selected quantity of additive may vary depending on whether dispensing is occurring, the concentration of additive in the existing fuel, and other factors. In this regard, controller 70 operates to open valve 66, allowing additive to flow from the reservoir 64 to the discharge location 60. As a result, the fuel additive may advantageously mix with the fuel being "dropped" to achieve better uniformity in its distribution throughout the fuel. Controller 70 utilizes meter 68 to determine when the desired amount of additive has been provided, at which point controller 70 causes valve 66 to close. As indicated at 114, controller 70 determines whether the fuel drop is continuing after the first incremental quantity of added fuel has been reached. If so, the process loops back to add the quantity of the continuing drop until the next incremental quantity is reached (which may be the same as or different from the previous incremental quantity). The process ends at 116.

The incremental quantities of added fuel and the corresponding quantities of fuel additive will vary depending on various factors, such as the type of fuel additive. For example, the system may track the additive level of the fuel over time and at each injection time will adjust the amount of additive injected based on fuel delivered and existing tank additive levels to target the desired additive concentration in the storage tank. The system can also be programmed to deliver a different level of additive depending on the fuel type or condition of the fuel being delivered. Sensors can then be deployed and accessed by the controller to track different fuel parameters such as octane, water content, cetane levels, etc. and adjust the additive levels based on that information.

Figure 4:
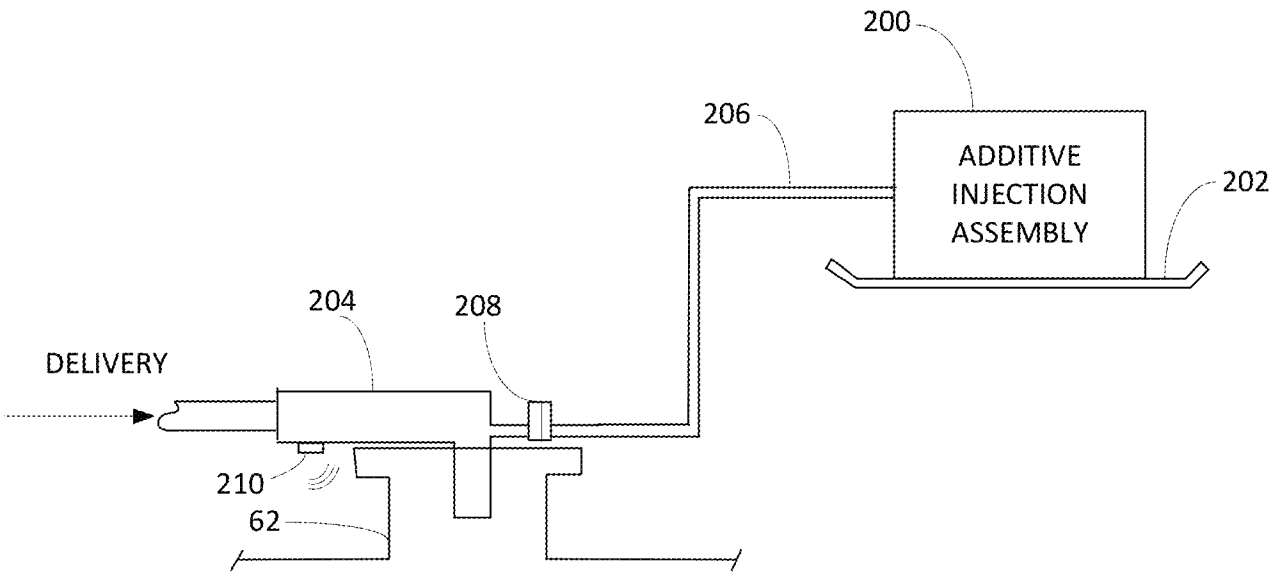
FIG. 4 is an enlarged diagrammatic representation of an additive injection assembly in accordance with another embodiment of the present invention.

FIG. 4 illustrates an alternative embodiment of an additive injection assembly in accordance with the present invention. In this case, additive injection assembly 200 is configured as a portable unit that can be moved from place to place around the service station. For example, the service station will typically have multiple USTs for different grades or type of fuel. Assembly 200 may be positioned adjacent to the delivery port 62 of a UST about to receive a fuel drop. Assembly 200 will generally include the same components as assembly 56, such as additive piping, an additive reservoir, a controller, a valve, and a meter. Assembly 200 will be in electronic communication with the tank monitor 42 and/or fuel dispensers 16 to operate in a manner substantially similar to assembly 56 described above. Components of assembly 200 may be mounted, for example, on a "skid" 202 to facilitate movement.

In this embodiment, the fuel additive is provided directly to a modified delivery elbow 204 from which the fuel is being dropped. Alternatively, an additional coupler can be provided adjacent the elbow that allows the additive line to be connected. The use of such a coupler is thus considered to provide the additive "at" the elbow. In this way, the fuel additive mixes more directly with the new fuel being delivered to the tank. Elbow 204 is in this embodiment adapted to connect with the additive piping 206 via a quick connect coupling 208. In order to further ensure that assembly 200 is associated with the correct UST, a wireless identifier reader 210 such as an RFID reader. For example, the UST may have a RFID tag indicating the identity of the UST and possibly other information such as the fuel grade or type that the UST contains. Reader 210 may be attached, as shown, to elbow 204 (or attached at another appropriate location). The RFID tag may be located at or near the fuel delivery port of the tank. This will allow for positive identification of the tank to which the assembly 200 is connected in order to obviate occurrences of incorrect additive that might otherwise occur.

It can thus be seen that embodiments of the present invention provide a fuel dispensing system with a novel additive injection assembly. Various embodiments of the present invention may realize one of more of the following advantages: (1) allows for the additization of fuel at the point of storage or use rather than at the terminal before it is delivered; (2) provides accurate fuel additization without knowing how much fuel is being delivered ahead of time and when the fuel delivery will begin and end; (3) eliminates manual data entry or errors that could occur if done manually; (4) eliminates the need to add an underground tank to the property to store the additive; (5) easy and low cost installation (no need to break ground or run wires); and (6) provides for adequate mixing of the fuel and additive by injecting small quantities into the delivery stream throughout the delivery of fuel to the tank.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A fuel dispensing system for dispensing fuel into a vehicle, said fuel dispensing system comprising:
- a stationary fuel tank adapted to contain a quantity of fuel;
- at least one fuel dispenser in fluid communication with said fuel tank via piping;
- a pump operative to transfer fuel from said fuel tank to said fuel dispenser;
- a level detector in the fuel tank;
- a tank monitor in electronic communication with the level detector, said tank monitor being operative to produce information indicative of the quantity of fuel in said fuel tank; and
- a fuel additive injection assembly comprising:
  - an additive reservoir configured to contain a quantity of fuel additive;
  - a controller in electronic communication with said tank monitor to receive information indicating a delivery of fuel into the fuel tank, said controller having a processor and memory operative to execute instructions determining when an additive quantity should be provided;
  - additive piping defining a flow path extending between the additive reservoir and a discharge location;
  - a valve situated along the flow path, said valve in electronic communication with the controller to open so that the fuel additive will flow along the flow path; and
  - a meter situated along the flow path and operative to measure a flow of the fuel additive, said meter in electronic communication with the controller.

2. A fuel dispensing system as set forth in claim 1, wherein said controller is operative, along with said valve and said meter, to provide a selected quantity of said fuel additive per incremental quantity of fuel delivered.

3. A fuel dispensing system as set forth in claim 1, wherein said fuel additive injection assembly is configured as a unit mounted on a mobile structure that can be moved from place to place.

4. A fuel dispensing system as set forth in claim 1, wherein said discharge location is situated to provide said fuel additive directly into said fuel tank.

5. A fuel dispensing system as set forth in claim 4, wherein said discharge location is at a fuel delivery port on said fuel tank.

6. A fuel dispensing system as set forth in claim 1, wherein said discharge location is at a delivery nozzle that is inserted into a fuel delivery port on said fuel tank.

7. A fuel dispensing system as set forth in claim 6, wherein said additive piping includes a quick-connect coupling for attaching said additive piping to said delivery nozzle.

8. A fuel dispensing system as set forth in claim 1, wherein said controller is further operative to receive dispensing information regarding dispensing of fuel at the at least one fuel dispenser and utilize said dispensing information in determining the additive quantity.

9. A fuel dispensing system as set forth in claim 8, wherein said controller is operative, along with said valve and said meter, to provide a selected quantity of said fuel additive per incremental quantity of fuel delivered.

10. A method for providing a fuel additive into a stationary fuel tank as fuel is delivered into the fuel tank, said method comprising steps of:
- (a) providing an additive injection assembly operative to selectively discharge the fuel additive into the fuel tank;

(b) determining that a delivery of the fuel into the fuel tank is occurring utilizing a probe in the fuel tank;

(c) determining when a first threshold quantity of the fuel has been delivered; and (d) injecting a first additive quantity of the fuel additive into the fuel tank based on delivery of the first threshold quantity.

11. A method as set forth in claim 10, wherein the determining step involves adding fuel being dispensed in determining the first additive quantity.

12. A method as set forth in claim 10, further comprising steps of:

(a) determining when a second threshold quantity of the fuel has been delivered; and (b) injecting a second additive quantity of the fuel additive into the fuel tank based on delivery of the second threshold quantity.

13. A method as set forth in claim 12, wherein the second threshold quantity of the fuel is equal to the first threshold quantity of the fuel and the second additive quantity of the fuel additive is equal to the first additive quantity of the fuel additive.

14. A fuel additive injection assembly comprising:

an additive reservoir configured to contain a quantity of fuel additive;

a controller adapted to be in electronic communication with a tank monitor to receive information indicating a delivery of fuel into a fuel tank, said controller having a processor and memory operative to execute instructions determining when an additive quantity should be provided;

additive piping defining a flow path extending between the additive reservoir and a discharge location;

a valve situated along the flow path, said valve in electronic communication with the controller to open so that the fuel additive will flow along the flow path; and a meter situated along the flow path and operative to measure a flow of the fuel additive, said meter in electronic communication with the controller, wherein the fuel additive injection assembly is configured as a unit mounted on a mobile structure that can be moved from place to place.

15. A fuel additive injection assembly as set forth in claim 14, wherein said additive piping includes a quick-connect coupling for attaching said additive piping to a delivery elbow.

16. A fuel additive injection assembly as set forth in claim 14, wherein said controller is operative, along with said valve and said meter, to provide a selected quantity of said fuel additive per incremental quantity of fuel delivered.

17. A fuel additive injection assembly as set forth in claim 14, further comprising a wireless identifier reader operative to read an identifier associated with a stationary fuel tank.

18. A fuel additive injection assembly as set forth in claim 14, wherein said controller is further operative to receive dispensing information regarding dispensing of fuel at one or more fuel dispensers and utilize said dispensing information in determining the additive quantity.

19. A fuel additive injection assembly as set forth in claim 18, wherein said controller is operative, along with said valve and said meter, to provide a selected quantity of said fuel additive per incremental quantity of fuel delivered.

20. A fuel additive injection assembly comprising:

an additive reservoir configured to contain a quantity of fuel additive;

a controller adapted to be in electronic communication with a tank monitor to receive information indicating a delivery of fuel into a fuel tank based on readings received by the tank monitor from a probe in the fuel tank, said controller having a processor and memory operative to execute instructions determining when an additive quantity should be provided;

additive piping defining a flow path extending between the additive reservoir and a discharge location;

a valve situated along the flow path, said valve in electronic communication with the controller to open so that the fuel additive will flow along the flow path; and a meter situated along the flow path and operative to measure a flow of the fuel additive, said meter in electronic communication with the controller.

* * * * *